US009752317B2

(12) United States Patent
Hochstuhl et al.

(10) Patent No.: US 9,752,317 B2
(45) Date of Patent: Sep. 5, 2017

(54) HEAT-INSULATING SYSTEM FOR THE VERTICAL, LOAD-DISSIPATING CONNECTION OF BUILDING PARTS TO BE PRODUCED FROM CONCRETE

(71) Applicant: Schock Bauteile GmbH, Baden-Baden (DE)

(72) Inventors: Jochen Hochstuhl, Gernsbach (DE); Martin Fenchel, Stutensee (DE); Hubert Fritschi, Baden-Baden (DE)

(73) Assignee: Schöck Bauteile GmbH, Baden-Baden (DE)

( * ) Notice: Subject to any disclaimer, the term of this patent is extended or adjusted under 35 U.S.C. 154(b) by 0 days.

(21) Appl. No.: 15/164,099

(22) Filed: May 25, 2016

(65) Prior Publication Data

US 2016/0369495 A1 Dec. 22, 2016

(51) Int. Cl.
*E04B 1/76* (2006.01)
*E04C 5/01* (2006.01)
(Continued)

(52) U.S. Cl.
CPC ..... *E04B 1/76* (2013.01); *E04B 1/78* (2013.01); *E04B 1/92* (2013.01); *E04C 1/41* (2013.01);
(Continued)

(58) Field of Classification Search
CPC ..... E04B 1/76; E04B 1/92; E04B 1/78; E04B 2001/7679; E04C 5/01; E04C 5/08
See application file for complete search history.

(56) References Cited

U.S. PATENT DOCUMENTS 8,590,240 B2 11/2013 Koch
8,590,241 B2 * 11/2013 Koch ..... E04B 1/161 52/394
(Continued)

FOREIGN PATENT DOCUMENTS

DE EP 2151531 A2 * 2/2010 ..... E04C 1/41
EP 2405065 1/2012

OTHER PUBLICATIONS

Office action for corresponding European application No. 16169173.8 mailed on Oct. 28, 2016 (7 pages).*

*Primary Examiner* — Rodney Mintz
(74) *Attorney, Agent, or Firm* — Volpe and Koenig, P.C.

(57) ABSTRACT

In order to provide a heat-insulating system which is intended for the vertical, load-dissipating connection of building parts to be produced from concrete and can be used in a variable manner and adapted, in accordance with the respective static requirements, to a large number of applications, the invention specifies a heat-insulating system which has an insulation body and one or more compressive force-carrying elements. The insulation body is configured with a plurality of apertures, which extend vertically therethrough from an upper side to an underside and into which a variable number of the compressive force-carrying elements, formed as individual compressive force-carrying elements, can be inserted. It is thus possible for the number and/or the nature of the individual compressive force-carrying elements to be adapted to the static requirements present in each case, and therefore the heat-insulating system is suitable for a large number of different applications.

9 Claims, 3 Drawing Sheets

(51) Int. Cl.

| | |
|---|---|
| ***E04C 5/08*** | (2006.01) |
| ***E04B 1/92*** | (2006.01) |
| ***E04C 1/41*** | (2006.01) |
| ***E04B 1/78*** | (2006.01) |

(52) U.S. Cl.
CPC ..... *E04C 5/01* (2013.01); *E04C 5/08* (2013.01); *E04B 2001/7679* (2013.01)

(56) References Cited

U.S. PATENT DOCUMENTS

| | | | | |
|---|---|---|---|---|
| 8,733,050 | B2 * | 5/2014 | Koch | E04B 1/161 52/394 |
| 8,852,473 | B1 * | 10/2014 | Tan | B29C 44/12 264/241 |
| 2008/0010913 | A1 * | 1/2008 | Fritschi | E04B 1/0038 52/167.1 |
| 2012/0144772 | A1 * | 6/2012 | Koch | E04B 1/161 52/700 |
| 2012/0159884 | A1 * | 6/2012 | Koch | E04B 1/161 52/396.05 |
| 2012/0186176 | A1 * | 7/2012 | Koch | E04B 1/161 52/291 |
| 2016/0312459 | A1 * | 10/2016 | Hochstuhl | E04B 1/41 |
| 2016/0312460 | A1 * | 10/2016 | Hochstuhl | E04B 1/41 |

* cited by examiner

HEAT-INSULATING SYSTEM FOR THE VERTICAL, LOAD-DISSIPATING CONNECTION OF BUILDING PARTS TO BE PRODUCED FROM CONCRETE

INCORPORATION BY REFERENCE

The following documents are incorporated herein by reference as if fully set forth: German Patent Application No. 102015109887.3, filed Jun. 19, 2015.

BACKGROUND

The present invention relates to a heat-insulating system for the vertical, load-dissipating connection of building parts to be produced from concrete, the system having an insulation body and one or more compressive load-bearing elements.

In building construction, load-bearing building parts are often produced from concrete structures provided with reinforcements. For reasons relating to energy, such building parts are usually then provided with externally applied heat insulation. In particular the floor structure between the basement, such as a cellar or underground garage, and first story often has heat insulation applied to it on the basement side. This gives rise to the difficulty of the load-bearing building parts on which the building rests, for example supports and external walls, having to be connected in a load-carrying manner to the building parts located above, in particular the floor structure. This is usually achieved by the floor structure, reinforced throughout, being connected monolithically to the load-bearing supports and external walls. However, this gives rise to heat bridges which are difficult to eliminate by way of heat insulation applied subsequently from the outside. In underground garages, for example it is often the case that the upper portion of the load-bearing concrete supports, said portion being oriented in the direction of the floor structure, is encased by heat insulation. Not only does this involve high outlay and is not particularly esthetically pleasing, but it also gives unsatisfactory structural results and, in addition reduces the amount of parking space available in the underground garage.

EP2405065 discloses a compressive-force-transmitting and insulating connection element which is used for the vertical, load-carrying connection of building parts to be produced from concrete. The connection element comprises an insulation body and a plurality of compressive force-carrying elements embedded therein. Transverse-force-reinforcement elements run through the compressive force-carrying elements, and, for connection to the building parts to be produced from concrete, extend essentially vertically beyond the upper side and the underside of the insulation body. The insulation body may be produced, for example, from foam glass or expanded polystyrene hard foam, and the compressive force-carrying elements may be produced from concrete, fiber concrete or fiber-reinforced plastics material.

The insulation body effects thermal separation of the building parts connected by it, in particular between an external wall and a floor structure resting thereon, wherein the compressive force resulting from the building is directed onward, via the compressive force-carrying elements, to the building part located therebeneath. The disadvantage here proves to be that either the position and size of the compressive force-carrying elements have to be adapted to the statics of the building, and the connection element thus has to be produced individually, or the connection element has to be designed for a maximum load, and it is therefore oversized for many applications.

SUMMARY

It has therefore been an object of the present invention to provide a heat-insulating system which is intended for the vertical, load-carrying connection of building parts to be produced from concrete and can be used in a variable manner and adapted, in accordance with the respective static requirements, to a large number of applications.

The object is achieved by a heat-insulating system with one or more features of the invention. Advantageous configurations can be gathered from the description below and the claims.

In the case of a heat-insulating system of the type mentioned in the introduction which has an insulation body and one or more compressive force-carrying elements, the insulation body is configured according to the invention such that it has a plurality of apertures, which extend vertically through the insulation body from an upper side to an underside and into which a variable number of the compressive force-carrying elements, designed in the form of individual compressive force-carrying elements, can be inserted. It is thus possible for the number and possibly also the nature of the individual compressive force-carrying elements to be adapted to the static requirements which are present in each case, and therefore the heat-insulating system is suitable for a large number of different applications.

It is also preferable to provide one or more blind plugs which are made of heat-insulating material and are, or can be, inserted into apertures not occupied by compressive force-carrying elements. Such blind plugs prevent liquid concrete from being able to penetrate into the open apertures during the concreting operation, which situation would have a disadvantageous effect on the structural properties of the heat-insulating system.

In the case of a preferred embodiment, the insulation body may be cuboidal. Such a cuboidal insulation body can be used either individually, for example for a relatively small support, in conjunction with a plurality of insulation bodies or in a row of a multiplicity of such insulation bodies, for example for a supporting wall.

The insulation body may also have an at least more or less central through-opening, which extends through the insulation body from the upper side to the underside and has a cross-sectional surface area which is larger than that of the apertures. Such an insulation body can be used as permanent formwork for producing a building part from fresh concrete, in which case said insulation body is integrated, in the form of an upper termination, in a formwork for the building part to be produced. The through-opening makes it possible for fresh concrete to be introduced into the formwork and for an internal vibrator to be subsequently introduced for the purpose of compacting the concrete within the formwork. It is preferable here to provide, in addition, a closure plug which can be inserted into the through-opening and is made of heat-insulating material. This plug is inserted into the through-opening following the concreting operation, and once any residues of fresh concrete remaining in the through-opening have been removed, so as to close said through-opening. This ensures that there is no heat bridge produced by way of the insulation body as a result of residues of concrete remaining within the through-opening.

The compressive force-carrying elements are retained within the apertures of the insulation body preferably by a friction fit. The compressive force-carrying elements are thus easily pushed into the apertures of the insulation body from above or below, with force being applied in the process, and remain there in a self-retaining manner by way of a friction fit. This allows extremely straightforward assembly of the heat-insulating system and good reliable handling in the process of producing the building parts.

The compressive force-carrying bodies and possibly the blind plugs may be cylindrical with preferably a circular, elliptical or polygonal cross section. They are particularly preferably cylindrical with a circular cross section.

It is also possible to provide, in the case of the heat-insulating system according to the invention, one or more through-extending reinforcement elements, which extend essentially vertically beyond the upper side and the underside of the insulation body. This ensures a reliable connection of the heat-insulating system to the building parts to be produced above and beneath. Such, preferably bar-like, reinforcement elements allow load to be transmitted predominantly in the direction of tension, whereas force is transmitted in the direction of compression by way of the individual compressive force-carrying elements.

If the reinforcement elements are angled at at least one end, this allows a straightforward connection to the reinforcement of the building parts to be produced above and/or beneath the same.

The compressive force-carrying elements are produced preferably from high-strength or ultra-high-performance concrete, which achieves a strength of more than 150 Nm per $mm^2$.

BRIEF DESCRIPTION OF THE DRAWINGS

Further features, advantages and properties of the present invention will be explained herein-below with reference to the figures and exemplary embodiments. In the figures.

DETAILED DESCRIPTION OF THE PREFERRED EMBODIMENTS

The following text will describe exemplary embodiments of a heat-insulating system which is used predominantly for the vertical, load-carrying connection of supports in the basement area to the building parts located thereabove. A support is understood to mean a vertical component which absorbs loads, and directs them onward, predominantly in the direction of its longitudinal axis. DIN standard 1041-1 defines a support as a bar-like compression member of which the larger cross-sectional dimension, in contrast to a wall, does not exceed four times the smaller dimension. In addition, however, it is also possible for the heat-insulating systems described to be used for connecting a supporting wall to the building structure located thereabove, in particular to a floor structure located thereabove.

Figure 1A:
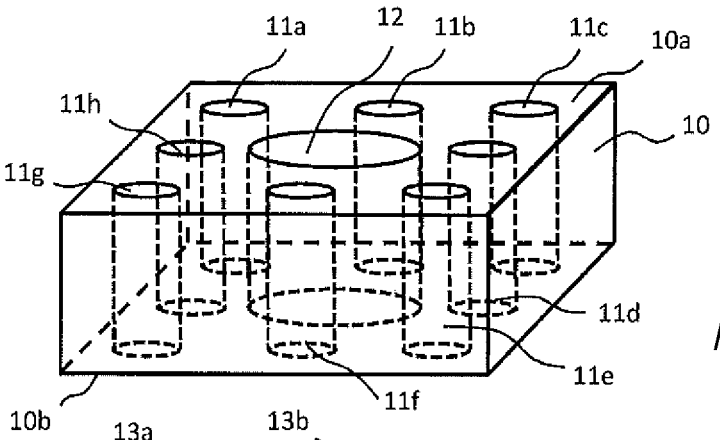
FIG. 1A shows an isometric illustration of an insulation body having a plurality of apertures for the insertion of individual compressive force-carrying elements.
Figure 1B:
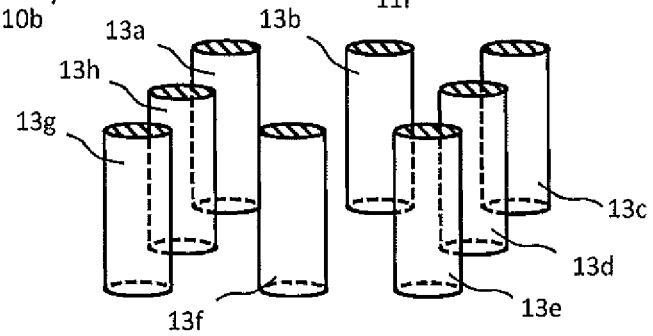
FIG. 1B shows a number of blind plugs for insertion into the apertures of the insulation body from FIG. 1A.
Figure 1C:
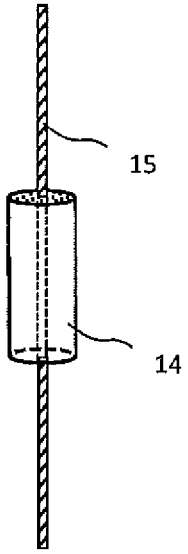
FIG. 1C shows an individual compression element with a reinforcement bar going through it.

In static terms, the connecting location between a support and a building structure, for example a floor structure, located thereabove is regarded, and calculated, as being an articulated point of connection, wherein the point of articulation is located on the lower edge of the floor structure. In practical terms, such supports nowadays are usually connected monolithically to the floor structure located thereabove, the reinforcement of the support being continued into the floor structure. If heat insulation is applied to the underside of the floor structure at a later date, then the point of connection of the support forms a heat bridge. The heat-insulating system according to the invention remedies this in that it provides a coupling element which can absorb loads between the support and floor structure and has simultaneously heat-insulating properties. FIGS. 1*a* to 1*c* illustrate the components of such a heat-insulating system individually.

FIG. 1A shows an insulation body 10 in the form of a cuboidal block of heat-insulating material. Examples of suitable heat-insulating material are a mineral insulating material, a wood wool multilayered insulating material, an expanded polystyrene hard foam (EPS, XPS) or foam glass.

The insulation body has an upper side 10*a* which serves as an abutment surface for a floor structure to be produced thereabove. The underside 10*b* of the insulation body serves, at the same time, as a termination for a load-bearing building part, for example a support, located therebeneath. The insulation body has a plurality of apertures of circular cross section extending vertically from the upper side 10*a* to the underside 10*b*, said apertures serving as holders for corresponding compressive force-carrying bodies. Arranged approximately centrally in the insulation body 10 is a through-opening 12, which likewise extends through the insulation body 10 from the upper side 10*a* to the underside 10*b*. The through-opening has a cross-sectional surface area which is larger than that of the apertures 11*a* to 11*h* for the compression bodies.

It is possible, albeit not essential, for corresponding cylindrical individual compressive force-carrying bodies to be inserted into the apertures 11*a* to 11*h*. If such bodies are not inserted, the apertures 11*a* to 11*h* are closed by corresponding blind plugs 13*a* to 13*h* made of heat-insulating material. FIG. 1B shows, by way of example, the eight blind plugs 13*a* to 13*h* which are inserted into the apertures 11*a* to 11*h*.

FIG. 1C shows an individual compressive force-carrying body 14, which can be inserted into one of the apertures 11*a* to 11*h* of the insulation body 10. The individual compressive force-carrying body 14 is cylindrical, wherein the diameter of the individual compressive force-carrying body 14 is selected to be approximately equal to the diameter of the apertures 11*a* to 11*h*. It is possible, if appropriate, for the diameter of the individual compressive force-carrying body 14 also be selected to be slightly larger, and therefore, upon insertion into one of the apertures 11*a* to 11*h* the insulating material of which the insulation body 10 consists is compressed slightly and the individual compressive force-carrying body 14 is thus retained reliably by static friction in the aperture 11*a* to 11*h*.

The axial length of the compressive force-carrying body 14 corresponds approximately to the height of the insulation body 10, and therefore, in the inserted state, the upper side and underside of the individual compressive force-carrying body terminates flush with the upper side 10*a* and the underside 10*b*, respectively, of the insulation body 10. It is also possible, however, for the axial length of the compressive force-carrying force element 14 to be selected to be slightly greater, and therefore, in the inserted state, the individual compressive force-carrying body 14 projects slightly beyond the upper side 10*a* and the underside 10*b* of the insulation body 10, so that, during the operation of concreting the support located therebeneath and/or the floor structure located thereabove, the compressive force-carrying body 14 is connected reliably to the relevant concrete structure.

A through-going reinforcement bar 15 runs axially through the compressive force-carrying body 14, said reinforcement bar being embedded in the compressive force-carrying body 14 and being enclosed thereby in a form-fitting manner. The reinforcement bar 15 serves as a reinforcement element for connection to the building parts to be produced thereabove and/or therebeneath and is intended to transmit in particular tensile forces which occur therebetween, and to a lesser extent possibly also transverse forces.

A material which has proven successful for producing the compressive force-carrying body 14 is high-strength concrete with a compressive strength >50 $Nmm^2$, but preferably ultra-high-performance concrete (UHPC) with a compressive strength of >150 $Nmm^2$. At least in the region in which it passes through the compressive force-carrying body 14, the reinforcement bar 15 is formed of a metal alloy with the lowest possible level of thermal conductivity, for example stainless steel. Since stainless steel is relatively expensive in comparison with normal structural steel, it is also possible for just the central region of the reinforcement bar 15 to be formed of stainless steel, whereas the extensions in the upper and lower regions of the reinforcement bar can be formed of normal structural steel welded thereto.

Figure 2:
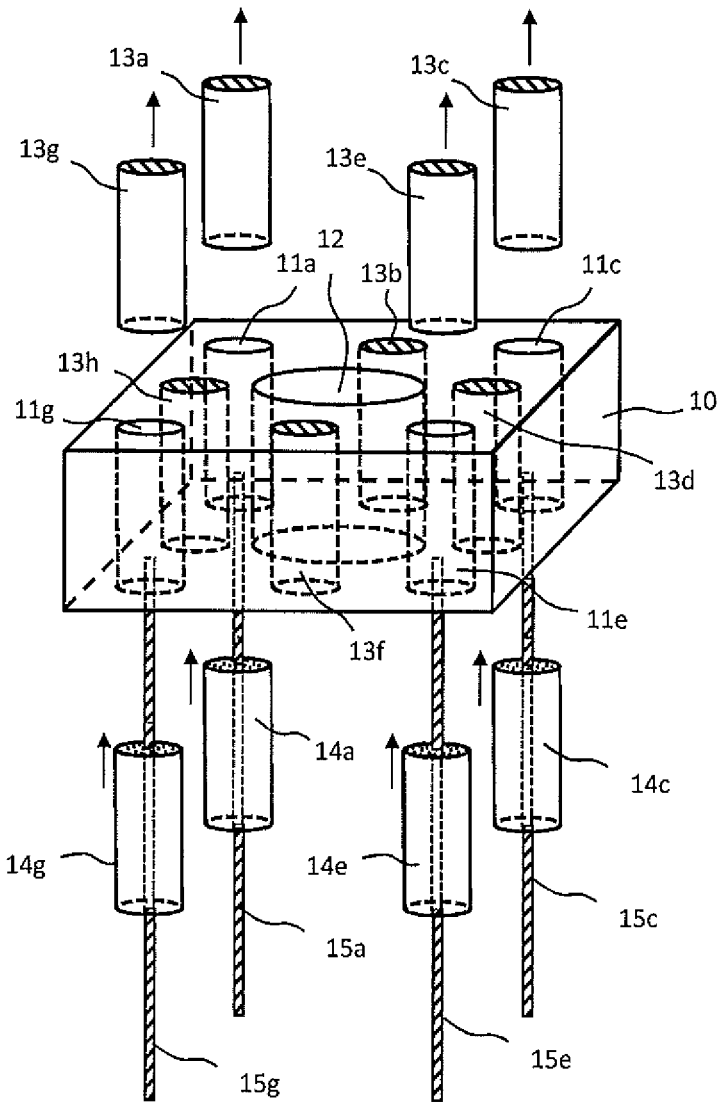
FIG. 2 shows an isometric illustration of a first exemplary embodiment of a heat-insulating system being assembled from the individual components shown in FIGS. 1A to 1C.

FIG. 2 shows a first exemplary embodiment for assembling the heat-insulating system according to the invention. First of all apertures 11*a* to 11*h* of the insulation body 10 have the associated blind plugs 13*a* to 13*h* inserted into them. Each of these blind plugs can be replaced individually by a corresponding compressive force-carrying body 14. The number and the arrangement of the compression bodies is determined here in dependence on the static requirements of the respective application. In the present example, of the total of eight possible apertures 11*a* to 11*h*, the intention is for four apertures 11*a*, 11*c*, 11*e* and 11*g* to be occupied by corresponding individual compressive force-carrying bodies 14*a*, 14*c*, 14*e* and 14*g*. For this purpose, then, first of all, the blind plugs 13*a*, 13*c*, 13*e* and 13*g* which are present in the delivery state of the insulation body 10, are pushed out of the insulation body 10. This is shown by corresponding arrows. Corresponding individual compressive force-carrying bodies 14*a*, 14*c*, 14*e* and 14*g* can then be inserted into the now empty apertures 11*a*, 11*c*, 11*e* and 11*g*. A corresponding through-going reinforcement bar 15*a*, 15*c*, 15*e* and 15*g* runs through each of the individual compressive force-carrying bodies 14*a*, 14*c*, 14*e* and 14*g*. The heat-insulating system made in this way can then be inserted, on site, into the formwork of the building parts to be produced, that is to say in the first instance the formwork for the support which is to be produced beneath the heat-insulating system. The reinforcement bars 15*a*, 15*c*, 15*e* and 15*g* here are preferably connected to corresponding reinforcement elements provided for the support.

It is then possible for liquid concrete to be introduced into the formwork of the support through the through-opening 12 in the insulation body 10. If the formwork has been filled to a sufficient extent, then an internal vibrator can be introduced through the through-opening, and this helps to compact the fresh concrete within the formwork of the support. Any air inclusions escape from the fresh concrete in the process. If, following vibration, the formwork is no longer filled with liquid concrete as far as the lower edge of the insulation body 10, then more concrete can possibly be introduced. It should be ensured, however, that the through-opening 12 within the insulation body 10 remains free of liquid concrete, so that there is no heat bridge formed by way of the insulation body 10. Any residues of concrete which are present should be removed, if appropriate. The through-opening 12 can then be closed by means of a closure plug (not shown).

If the support produced from concrete has hardened, then the formwork can be removed. The insulation body remains as a permanent part of the formwork at the upper end of the support. Production of the floor structure borne by the support can then begin. For this purpose, an appropriate formwork, of which the upper side should terminate flush with the upper side 10*a* of the insulation body 10, is in turn produced. A corresponding reinforcement of the floor structure is connected to those ends of the reinforcement bars 15*a*, 15*c*, 15*e* and 15*g* which project above the insulation body 10. The floor structure can then be concreted in a customary manner.

Figure 3:
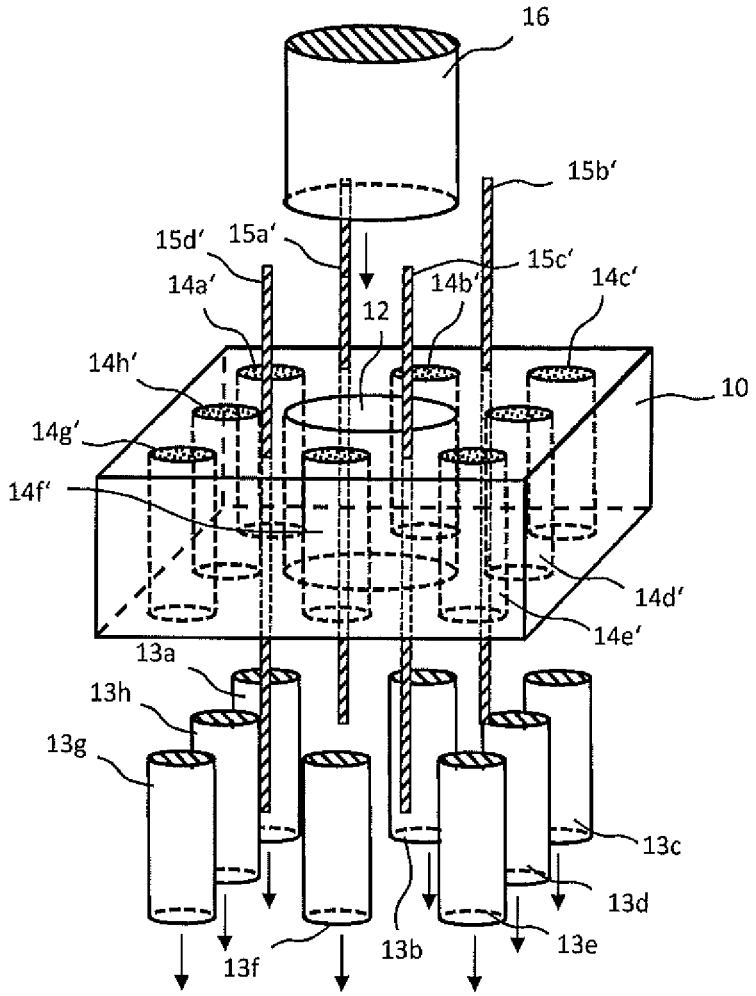
FIG. 3 shows an isometric illustration of a second exemplary embodiment of a heat-insulating system according to the invention having separate reinforcement elements.

A second exemplary embodiment for a heat-insulating system according to the invention is shown in FIG. 3. The insulation body 10 here corresponds essentially to the insulation body of the first exemplary embodiment. It likewise has eight cylindrical apertures for accommodating individual compressive force-carrying bodies, said apertures being closed by blind plugs 13*a* to 13*h* in the delivery state. The insulation body 10 contains a central, likewise cylindrical through-opening 12, which serves for the introduction and compaction of fresh concrete.

For using the heat-insulating system as shown in FIG. 3, the blind plugs 13*a* to 13*h*, which are present in the delivery state, are pushed out of the apertures of the insulation body 10 and replaced by corresponding cylindrical individual compressive force-carrying bodies 14*a*' to 14*h*'. The compressive force-carrying bodies 14*a*' to 14*h*' differ from the compressive force-carrying bodies 14*a* to 14*g* of the first exemplary embodiment in that the compressive force-carrying bodies here do not have any reinforcement elements 15*a* to 15*g* passing through them. Rather, four separate reinforcement bars 15*a*' to 15*d*' are plugged through the comparatively soft insulating material of which the insulation body 10 is formed and pass through the underside and upper side of the insulation body 10 approximately vertically. The reinforcement bars 15*a*' to 15*d*' may be connected to the reinforcement of the building parts to be produced thereabove and/or therebeneath and serve, in particular, to transmit tensile forces which occur therebetween.

Once an appropriate formwork has been produced, is the building part to be produced beneath the heat-insulating system, in particular a column, in the case of which the insulation element serves as an upper termination and, at the same time as a permanent formwork body, fresh concrete can be introduced through the through-opening 12 and compacted an internal vibrator. Any residues of fresh concrete which possibly remain are then removed from the through-opening 12 and a closure plug 16 made of heat-insulating material is inserted into said through-opening. It is then also possible, as in the first exemplary embodiment, for a formwork for the building part to be produced above the heat-insulating system, in particular a floor structure to be constructed, for a corresponding reinforcement to be produced, and connected to the reinforcement bars 15*a*' to 15*d*', and then for the building part to be produced from fresh concrete.

As in the first exemplary embodiment, it is also advantageous if at least the central part of the reinforcement bars 15*a*' to 15*d*' consists of a metal alloy with poor thermal conductivity, in particular stainless steel, whereas the upper and lower ends of the reinforcement bars 15*a*' to 15*d*' can consist of normal structural steel, which is connected integrally to the central stainless-steel portions by a joining process, in particular welding. Moreover, it may be advantageous if the reinforcement bars 15*a*' to 15*d*' are angled in the upper and/or lower regions (not shown), so that they can be connected possibly to better effect to a vertically running reinforcement of the building parts to be produced thereabove and/or therebeneath.

Although the invention is not restricted to this, the dimensions of the insulation body 12 in the exemplary embodiments are approximately 25×25 cm over the base surface area, with a height of approximately 10 m cm. The individual compressive force-carrying bodies 14 have a slightly greater height of 11 to 13 cm, with a diameter of approximately 5 cm. The reinforcement bars 15 have a diameter of 10 mm, greater dimensions, of, for example 14 mm also being possible here. In the exemplary embodiment, the through-opening 12 has a diameter corresponding to DN 120.

The height of the insulation bodies is typically selected to correspond to the thickness of a provided insulating-material layer between 8 and 20 cm, preferably between 10 and 15 cm. The height (or length) of the individual compression elements is adapted correspondingly.

The base surface area of the insulation bodies is adapted to a unit dimensioning, for example 25 cm or 30 cm, of concrete structures (supports or walls) which are typically to be produced, in order to allow use which is as flexible as possible.

In the exemplary embodiment, each individual compressive force-carrying element 14 can absorb a compressive force of 150 kN, and therefore, with a total of 8 compression elements being used, a compressive force of 1200 kN can be transmitted. In the case of higher levels of loading, it is possible to combine a plurality of insulation bodies for a larger support, for example, for an elongate support with a base surface area of 25×75 cm, it is possible to arrange three insulation bodies one beside the other.

The invention claimed is:

1. A heat-insulating system for vertical load-carrying connection of building parts to be produced from concrete, the system comprising:

an insulation body and one or more compressive force-carrying elements, the insulation body has a plurality of apertures which extend vertically through the insulation body from an upper side to an underside thereof, wherein a variable number of the compressive force-carrying elements, designed as individual compressive force-carrying elements, are removably inserted into the plurality of apertures, and wherein at least one said aperture of the plurality of apertures is not occupied by the compressive force-carrying elements, and at least one blind plug composed of a heat-insulating material is positioned in the at least one aperture not occupied by the compressive force-carrying elements.

2. The heat-insulating system according to claim 1, wherein the insulation body is cuboidal.

3. The heat-insulating system according to claim 1, wherein the compressive force-carrying elements are retained in the apertures of the insulation body by a friction fit.

4. The heat-insulating system according to claim 1, wherein the compressive force-carrying elements and the blind plugs are approximately cylindrical with a circular, elliptical or polygonal cross section.

5. The heat-insulating system according to claim 1, wherein the compressive force-carrying elements are produced from a high-strength concrete.

6. The heat-insulating system according to claim 1, wherein the insulation body has an at least central through-opening, which extends through the insulation body from the upper side to the underside and has a cross-sectional surface area which is larger than that of the apertures.

7. The heat-insulating system according to claim 6, further comprising a closure plug which is insertable into the through-opening and is made of heat-insulating material.

8. The heat-insulating system according to claim 1, further comprising through-extending reinforcement elements extending approximately vertically beyond the upper side and the underside of the insulation body.

9. The heat-insulating system according to claim 8, wherein the reinforcement elements are angled at at least one end.

* * * * *